US012280918B2

(12) United States Patent
Zanon et al.

(10) Patent No.: US 12,280,918 B2
(45) Date of Patent: Apr. 22, 2025

(54) LID-SPOUT ASSEMBLY FOR A PACKAGE AND PACKAGE HAVING A LID-SPOUT ASSEMBLY

(71) Applicant: Tetra Laval Holdings & Finance S.A., Pully (CH)

(72) Inventors: Paolo Zanon, Modena (IT); Anna Rosa Vietri, Modena (IT); Rocco De Paola, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 268 days.

(21) Appl. No.: 18/245,738

(22) PCT Filed: Oct. 5, 2021

(86) PCT No.: PCT/EP2021/077369

§ 371 (c)(1),
(2) Date: Mar. 17, 2023

(87) PCT Pub. No.: WO2022/078811

PCT Pub. Date: Apr. 21, 2022

(65) Prior Publication Data

US 2023/0356888 A1 Nov. 9, 2023

(30) Foreign Application Priority Data

Oct. 15, 2020 (EP) ..... 20201953

(51) Int. Cl.
*B65D 5/74* (2006.01)
*B65D 41/32* (2006.01)
(Continued)

(52) U.S. Cl.
CPC ..... *B65D 41/32* (2013.01); *B65D 5/746* (2013.01); *B65D 5/749* (2013.01);
(Continued)

(58) Field of Classification Search
CPC .... B65D 41/32; B65D 5/746; B65D 47/0838; B65D 2547/066; B65D 2251/1008; B65D 5/749
See application file for complete search history.

(56) References Cited

U.S. PATENT DOCUMENTS 4,721,218 A 1/1988 Gregory et al.
10,954,023 B2 * 3/2021 Winberg ..... B65D 5/065
(Continued)

FOREIGN PATENT DOCUMENTS

EP 0213742 A2 3/1987
JP 2005335797 A 12/2005
JP 2018203338 A 12/2018

OTHER PUBLICATIONS

International Search Report mailed Feb. 24, 2023, for priority International Patent Application No. PCT/EP2021/077369.

*Primary Examiner* — Frederick C Nicolas
(74) *Attorney, Agent, or Firm* — Renner, Otto, Boisselle & Sklar, LLP

(57) ABSTRACT

There is described lid-spout assembly for a package having a designated pour opening and being filled with a pourable product. The lid-spout assembly comprises at least a collar, a coupling ring arranged around a portion of the collar, a lid and a connecting element connecting the lid and the coupling ring with one another. The collar comprises a first annular interaction ridge and the coupling ring has at least one flap including at least one engagement surface abutting and/or designed to abut against an abutment surface of the first annular interaction ridge. The collar also comprises a second annular interaction ridge protruding from the outer surface of the collar and being axially displaced from the first annular interaction ridge. The flap further comprises at least one contact surface designed to interact and/or interacting with a guiding surface of the second annular inter-
(Continued)

action ridge so as to direct the engagement surface towards and/or against the abutment surface.

15 Claims, 4 Drawing Sheets

(51) Int. Cl.
*B65D 41/48* (2006.01)
*B65D 47/08* (2006.01)
*B65D 47/36* (2006.01)

(52) U.S. Cl.
CPC .. *B65D 47/0838* (2013.01); *B65D 2251/1008* (2013.01); *B65D 2547/066* (2013.01)

(56) References Cited

U.S. PATENT DOCUMENTS

2023/0124456 A1* 4/2023 Morciano ..... B65D 51/228
222/556
2023/0127158 A1* 4/2023 Morciano ..... B65D 47/103
222/556
2023/0137895 A1* 5/2023 Morciano ..... B65D 51/228
222/528

* cited by examiner

LID-SPOUT ASSEMBLY FOR A PACKAGE AND PACKAGE HAVING A LID-SPOUT ASSEMBLY

TECHNICAL FIELD

The present invention relates to a lid-spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a lid-spout assembly.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages, in particular sealed main bodies of the packages formed from the packaging material, comprise a designated pour opening, which allows the outpouring of the pourable product from the packages. Typically, the designated pour opening is covered by a separation membrane, which isolates the inner space of the package from the outer environment and whose integrity needs to be destroyed prior to the first outpouring of the pourable product so as to allow for the outpouring of the pourable product through the designated pour opening. It is also known to arrange a lid-spout assembly on the main body about the designated pour opening allowing for a controlled outflow of the pourable product.

There are known lid-spout assemblies, which comprise a spout having a collar provided with a pouring outlet, a coupling ring arranged around the collar, a lid configured to allow to selectively close and open the pouring outlet and a tethering element tethering the coupling ring and the lid to one another.

In order to ensure that, in use, the coupling ring and therewith also the lid remain coupled to the collar, the collar is provided with an annular ridge and the connecting ring is provided with a plurality of counter-ridges radially protruding from an inner surface of the connecting ring and configured to interact with the annular ridge of the collar so as to limit the axial movement of the coupling ring once the coupling ring is coupled to the collar.

Even though these kinds of lid-spout assemblies work satisfyingly well, some inconveniences have been encountered.

For example, the retaining forces provided by the interaction between the annular ridge and the counter-ridges of the coupling ring are limited in the case that the collar is made from a soft material such as LDPE. In particular, the radial extension of the annular ridge must be limited in order to allow coupling of the coupling ring onto the collar, which, however, leads to a limited tethering force.

Thus, a desire is felt in the sector to provide for an improved lid-spout assembly.

In particular, a desire is felt in the sector to provide for a lid-spout assembly, which allows for a good tethering force and even more particular, which works both on collars made from a hard material and collars made from a soft material.

DISCLOSURE OF INVENTION

It is therefore an object of the present invention to provide in a straightforward and low-cost manner an improved lid-spout assembly for a package, in particular a package having a sealed main body, filled with a pourable product, even more particular filled with a pourable food product, which solves at least one of the above-mentioned inconveniences.

It is a further object of the present invention to provide in a straightforward and low-cost manner a package, in particular a package having a sealed main body filled with a pourable product, in particular filled with a pourable food product, having a lid-spout assembly, which solves at least one of the above-mentioned inconveniences.

According to the present invention, there is provided a lid-spout assembly according to the independent claim.

Further advantageous embodiments of the lid-spout assembly are specified in the respective dependent claims.

According to the present invention, there is also provided a package according to any one of claims 13 to 15.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
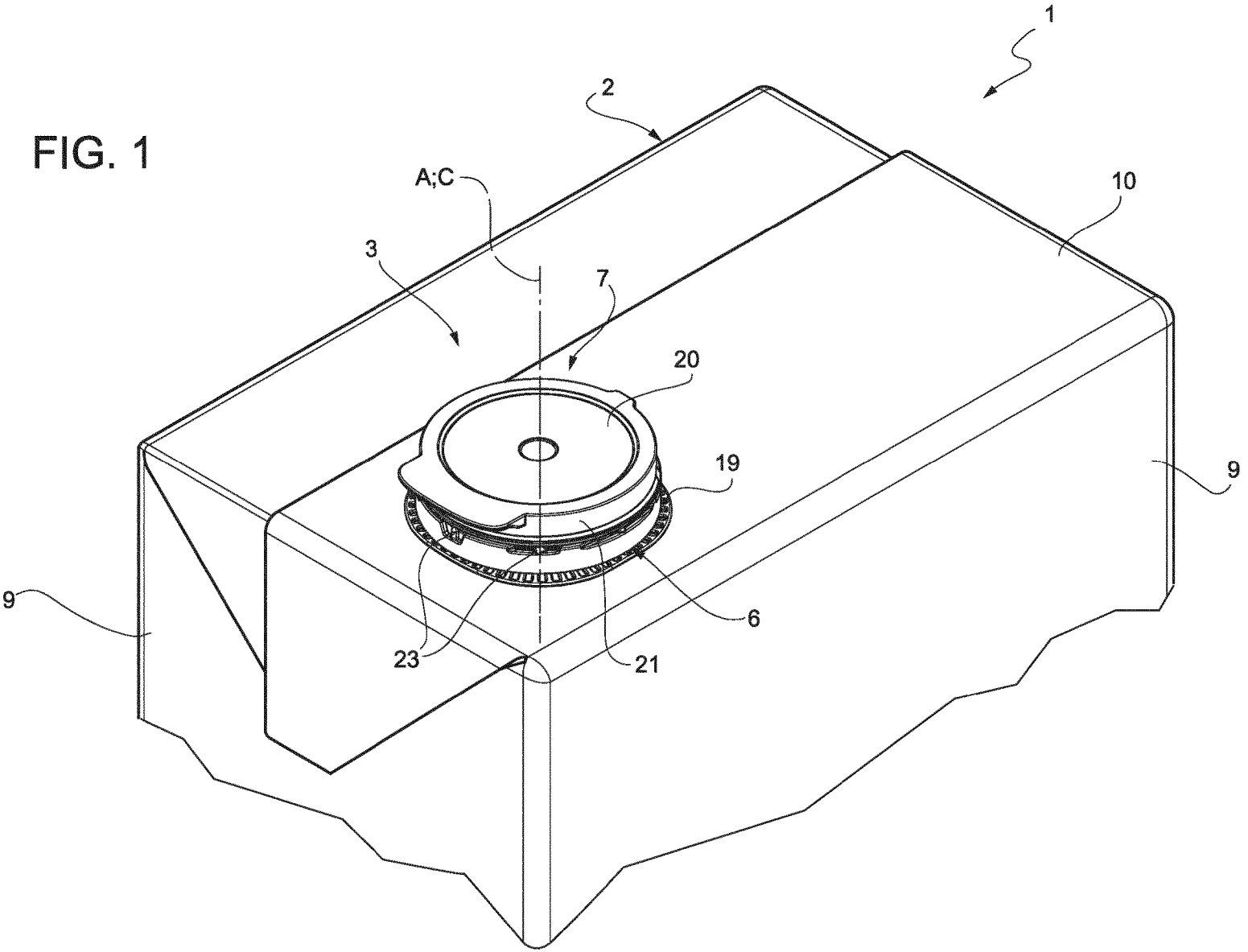
FIG. 1 is a schematic perspective view of a portion of a package having a lid-spout assembly according to the present invention, with parts removed for clarity.

Number 1 indicates as a whole a package (only partially shown to the extent necessary for the comprehension of the present invention) comprising:

- a sealed main body 2, in particular a sealed carton package being filled and/or being fillable with a pourable product, in particular a pourable food product, and in particular having a designated pour opening (not shown and known as such) configured to allow for an outflow of the pourable product from main body 2; and
- a lid-spout assembly 3 coupled to the sealed main body 2.

According to some preferred non-limiting embodiments, main body 2 is obtained from a packaging material, in particular a composite packaging material, having a multilayer structure (not shown and known as such).

Preferentially, the packaging material is provided in the form of a (n) (endless) web.

Preferentially, main body 2 is obtained by forming a tube from the packaging material, longitudinally sealing the tube, filling the tube with the pourable product, shaping the tube, and transversally sealing and cutting the tube.

Preferentially, the packaging material comprises at least one layer of fibrous material, such as e.g. a paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil and/or ethylene vinyl alcohol (EVOH) film, in particular being arranged between one of the layers of the heat-seal plastic material and the layer of fibrous material. Preferentially, the packaging material also comprises a further layer of heat-seal plastic material being interposed between the layer of gas- and light-barrier material and the layer of fibrous material.

In more detail, lid-spout assembly 3 comprises at least:

- a spout 4 having a collar 5 arranged and/or arrangeable about the designated pour opening;
- a coupling ring 6 arranged and/or arrangeable around collar 5;
- a lid 7; and
- a connecting element 8 (permanently) connecting lid 7 and coupling ring 6 to one another.

According to some preferred non-limiting embodiments, spout(s) 4 is (are) applied to package(s) 1 prior, during or after the formation, filling and sealing of main body(ies) 2.

Alternatively, spout(s) 4 can be applied onto the packaging material prior to arranging the packaging material within or during advancement of the packaging material through a packaging machine for forming, filling, and sealing main bodies 2 from the packaging material.

In particular, application of spout(s) 4 to the packaging material or to main body 2 occurs by means of a molding process and/or adhesive bonding and/or ultrasonic bonding and/or fusion.

Preferentially, coupling ring 6 and lid 7 are coupled to spout 4 prior or after application of spout 4 onto main body 2 or onto the packaging material.

According to some preferred non-limiting embodiments, lid-spout assembly 3, in particular spout 4, coupling ring 6, lid 7 and connecting element 8, is/are formed and/or molded from a polymer. Preferentially, lid 7, connecting element 8 and coupling ring 6 are molded separately from spout 4. Even more preferentially, lid 7, connecting element 8 and coupling ring 6 are molded as a single piece.

With particular reference to FIG. 1, main body 2 extends along a longitudinal axis, a first transversal axis and a second transversal axis. In particular, the extension of package 1 along its longitudinal axis is larger than the extension of package 1 along its first transversal axis and its second transversal axis.

Preferentially, main body 2 is parallelepiped-shaped.

In more detail, main body 2 comprises a first wall portion (not shown and known as such), in particular being transversal, even more particular perpendicular, to the longitudinal axis of main body 2. Preferably, the first wall portion defines a support surface of package 1, in particular main body 2, which is designed to be put in contact with a support, such as e.g. a shelf, when, in use, being e.g. exposed within a sales point or when being stored. In particular, when being arranged on a support the first wall portion defines a bottom wall portion.

In even more detail, main body 2 also comprises a plurality of lateral walls 9 being (fixedly) connected to the first wall portion and extending, in particular substantially parallel to the longitudinal axis, from the first wall portion.

Moreover, main body 2 comprises a second wall portion 10 opposite to the first wall portion and being (fixedly) connected to at least some of lateral walls 9. In particular, lateral walls 9 are interposed between the first wall portion and second wall portion 10. In particular, when the first wall portion is arranged on a support, second wall portion 10 defines a top wall portion.

According to some non-limiting embodiments, the first wall portion and second wall portion 10 may be parallel to one another.

According to some non-limiting alternative embodiments not shown, the first wall portion and second wall portion 10 could be inclined with respect to one another.

Preferentially, second wall portion 10 carries and/or comprises the designated pour opening.

According to a preferred non-limiting embodiment, main body 2 comprises a separation membrane (not shown and known as such) covering the designated pour opening. In particular, the separation membrane separates in the area of, in particular at, the designated pour opening an inner space of main body 2 from an outer environment. Preferentially, the separation membrane comprises a gas- and light-barrier material, e.g. aluminum foil or ethylene vinyl alcohol (EVOH) film.

In particular, during the first-time use (see further below for more details), the separation membrane is at least partially removed and/or pierced and/or opened and/or ruptured and/or cut for allowing the pourable product to flow out of the inner space of main body 2.

According to a preferred non-limiting embodiment, the separation membrane is defined by a portion of the packaging material, in particular a portion of the layers of the packaging material being different from the layer of fibrous material.

Figure 2:
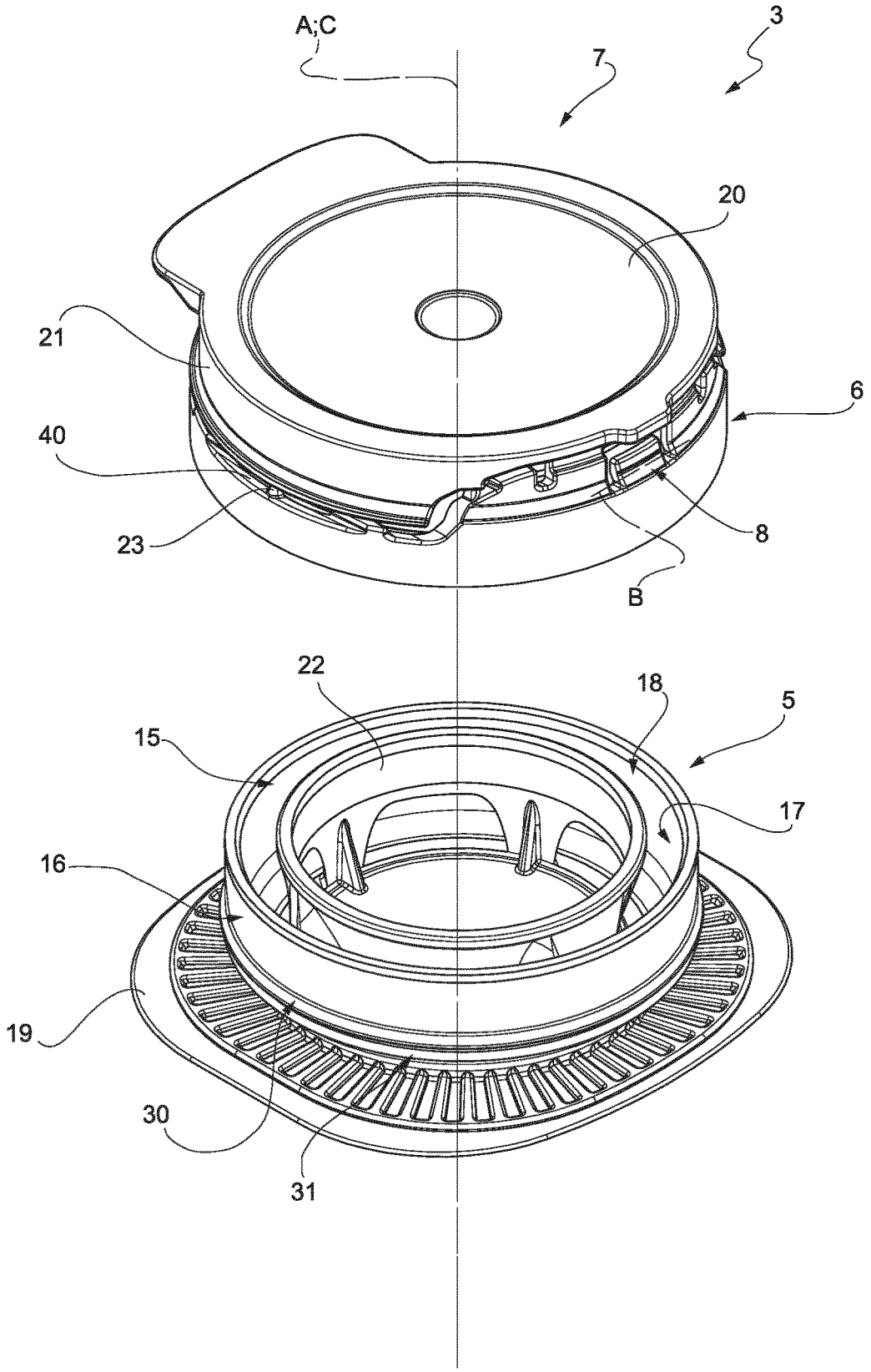
FIG. 2 is an exploded view of the lid-spout assembly of FIG. 1, with parts removed for clarity.
Figure 3:
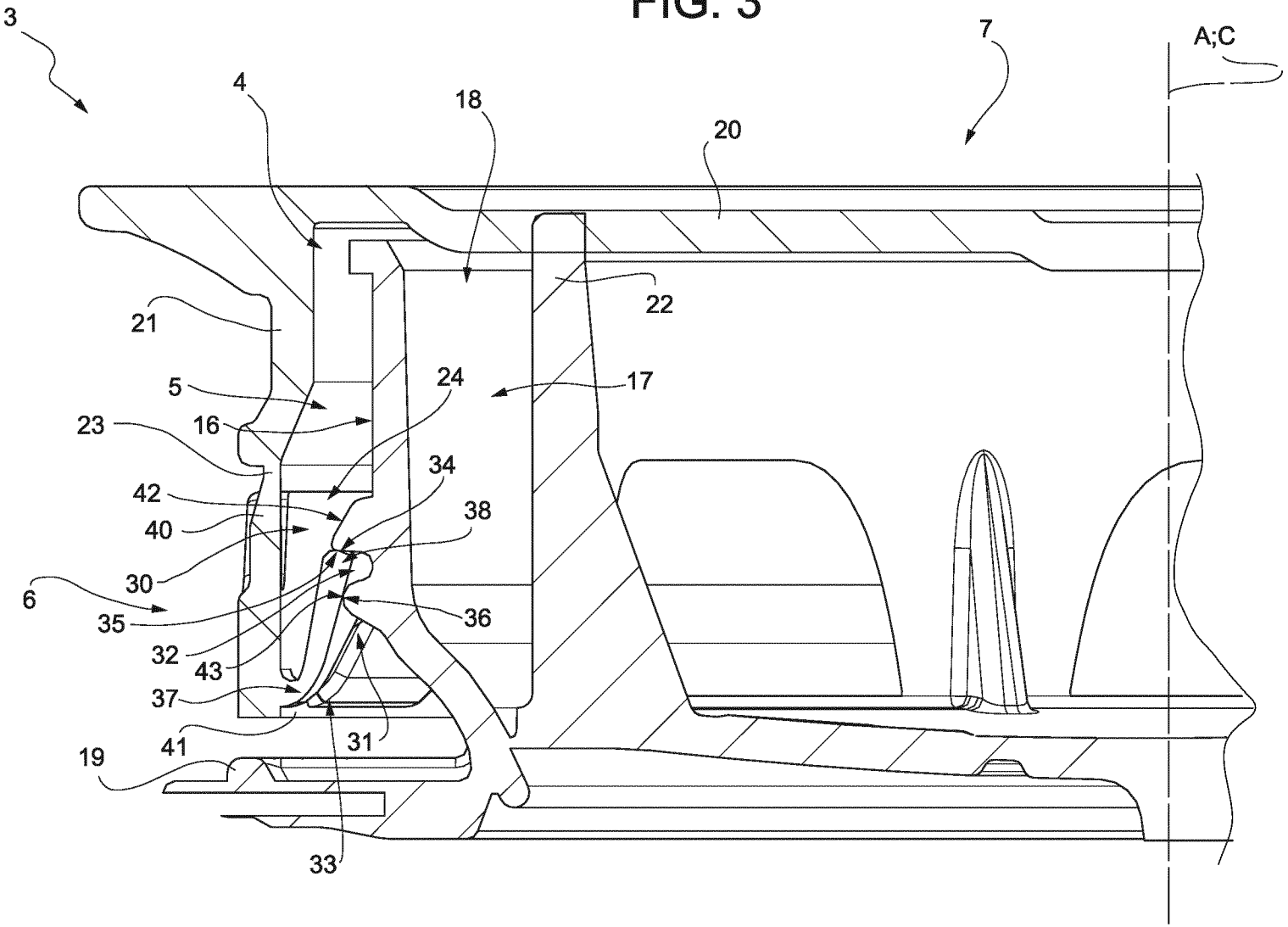
FIG. 3 is a sectionized enlarged view of some details of the lid-spout assembly of FIG. 1, with parts removed for clarity.

With particular reference to FIGS. 2 and 3, collar 5 carries and/or comprises a pouring outlet 15 configured to allow for the outflow of the pourable product from package 1.

In more detail, collar 5 comprises an outer surface 16 and in particular also an inner surface 17 opposite to outer surface 16.

Furthermore, collar 5 extends along a (longitudinal) central axis A and delimits a flow channel 18 for the pourable product extending along central axis A. In particular, inner surface 17 faces and/or delimits flow channel 18.

In particular, collar 5 has a tubular configuration.

Even more particular, collar 5 has an annular cross-sectional profile with respect to a cross-sectional plane perpendicular to central axis A.

In more detail, collar 5 carries pouring outlet 15 at a first axial end of collar 5 and an inlet opening for the pourable product at a second axial end of collar 5 opposite to the first axial end. In particular, flow channel 18 extends between the inlet opening and pouring outlet 15. In use, collar 5 is configured such to receive the pourable product from the inner space of main body 2 through the inlet opening and such that the pourable product flows out of pouring outlet 15.

Preferentially, spout 4 also comprises a base frame 19 coupling and/or configured to couple spout 4 to main body 2, in particular to second wall portion 10, about the designated pour opening.

In more detail, collar 5 is (integrally) connected to base frame 19 and (axially) extends from base frame 19.

According to some preferred non-limiting embodiments, lid 7 is configured to selectively close and open pouring outlet 15. In particular, lid 7 is controllable between at least:

- a closed configuration (see FIGS. 1 and 3), in which lid 7 is configured to cover and/or covers pouring outlet 15, in particular for impeding an outflow of the pourable product out of pouring outlet 15; and
- an open configuration (not shown), in which lid 7 is configured to be and/or is detached from pouring outlet 15, in particular for allowing an outflow of the pourable product through pouring outlet 15.

According to the specific embodiment disclosed in FIGS. 1 to 4, lid 7 is angularly moveable around a hinge axis B (see FIG. 2) defined by connecting element 8 so as to control lid 7 between the closed configuration and the open configuration.

In more detail, lid 7 is in a first angular position and in a second angular position with respect to hinge axis B when being controlled in respectively the closed configuration and the open configuration.

It should be noted that package 1 is immediately after its formation in an initial configuration in which lid 7 is in the closed configuration. Package 1 is distributed and/or sold to a consumer while being in the initial configuration.

With particular reference to FIGS. 1 to 4, lid 7 comprises a top wall 20 and a side wall 21 protruding from top wall 20.

In more detail, top wall 20 is configured to cover and/or covers pouring outlet 15 with lid 7 being controlled in the closed configuration and side wall 21 is configured to at least partially surround and/or surrounds collar 5 with lid 7 being arranged in the closed configuration.

Preferentially, top wall 20 and side wall 21 delimit an internal space having a (substantially) cylindrical shape. In particular, the internal space houses at least a portion of collar 5 (and flow channel 18) with lid 7 being arranged in the closed configuration.

With particular reference to FIGS. 2 and 3, lid-spout assembly 3 also comprises an opening arrangement 22 coupled to lid 7 and configured to at least partially open and/or cut and/or rupture and/or remove the separation membrane during the first time control of lid 7 from the closed configuration to the open configuration.

According to the non-limiting embodiment shown, opening arrangement 22 comprises a (polymer) covering layer fused and/or connected to the separation membrane and/or defining at least partially the separation membrane and a coupling member connected to the covering layer and lid 7. In use, movement of lid 7 also leads to a movement of the covering layer and consequently of the separation membrane.

Alternatively, opening arrangement 22 could be in the form of a cutter or a strapping element could be connected and/or fused to the separation membrane so that the consumer could remove the strapping element from package 1 together with the separation membrane.

Moreover, lid-spout assembly 3 also comprises one or more rupturable coupling bridges 23 connecting coupling ring 5 and lid 7 with one another. Coupling bridges 23 are designed to irreversibly rupture during the first control of lid 7 from the closed configuration to the open configuration. In this manner, lid-spout assembly 3 provides for a tamper-evidence.

Figure 4:
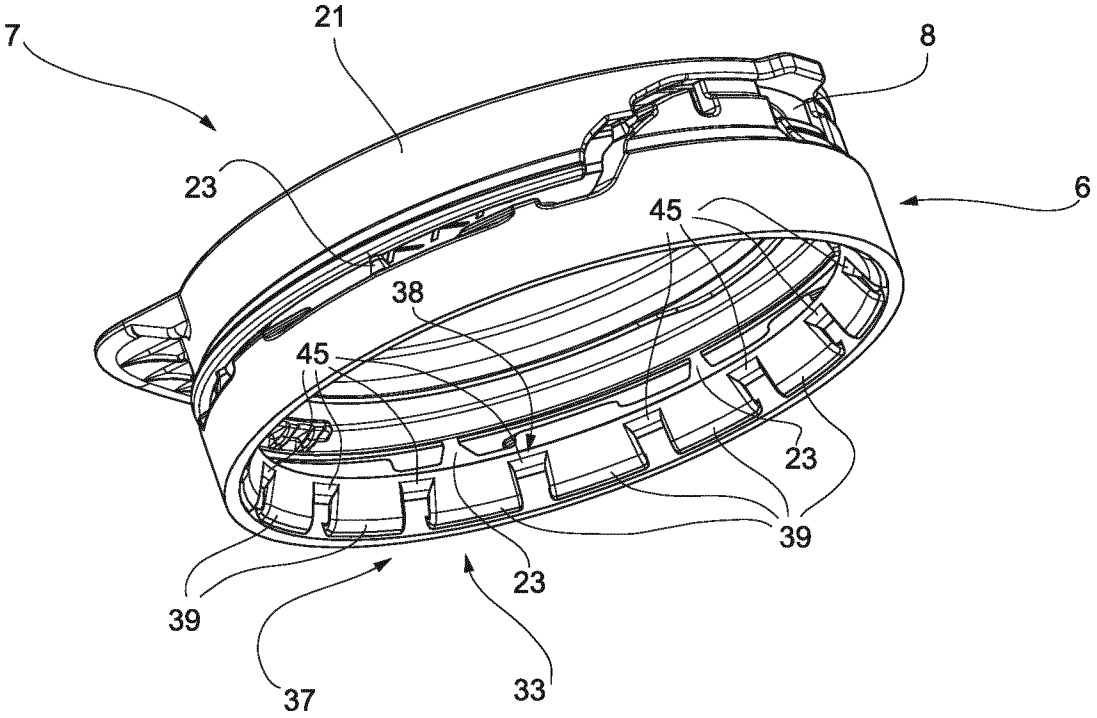
FIG. 4 is a perspective view of a detail of the lid-spout assembly of FIG. 1, with parts removed for clarity.

With particular reference to FIGS. 3 and 4, coupling ring 6 comprises an inner surface 24 facing outer surface 16 with coupling ring 6 being coupled to collar 5.

Preferentially, coupling ring 6 comprises a central axis C, in particular being parallel, even more particular coaxial to central axis A, with coupling ring 6 being coupled to (arranged around) collar 5.

Furthermore, coupling ring 6 is rotatably coupled to collar 5 so as to be adapted to rotate around central axis C.

Advantageously and with particular reference to FIGS. 2 and 3, lid-spout assembly 3 comprises a retaining group configured to guarantee that coupling ring 6 remains coupled to collar 5 once coupling ring 6 has been arranged around and/or coupled to collar 5, in particular during a normal use of lid-spout assembly 3. It should be noted that a normal use is defined by exerting the forces which are required for moving lid 7 between the closed configuration and the opening configuration and in particular without applying forces which are significantly higher than the needed ones. Furthermore, during a normal use, a consumer does not rely on specific tools for removing coupling ring 6 from collar 5.

As it will be explained in more detail further on, the retaining group is partially associated to coupling ring 6 and partially associated to collar 5. In other words, portions of coupling ring 6 and portions of collar 5 define in combination the retaining group.

In particular, retaining group is configured to delimit the axial movement of coupling ring 6 (along central axis C and/or central axis A).

In more detail, collar 5 comprises a first annular interaction ridge 30 and a second annular interaction ridge 31, in particular axially displaced (with respect to central axis A) from first annular interaction ridge 30, and both first annular interaction ridge 30 and second annular interaction ridge 31 (radially) protrude from outer surface 16.

In particular, first annular interaction ridge 30 and second annular interaction ridge 31 delimit and/or define a groove 32.

Moreover, groove 32 is free of any other element.

In particular, first annular interaction ridge 30 is (axially) closer to pouring opening 15 than second annular interaction ridge 31.

In particular, first annular interaction ridge 30 and second annular interaction ridge 31 define a first portion of the retaining group.

Furthermore, coupling ring 6 comprises at least one (elastically moveable and/or deflectable) flap 33 connected to and protruding away from inner surface 24. In particular, flap 33 defines a second portion of the retaining group.

In more detail, flap 33 comprises at least one engagement surface 34 abutting and/or designed to abut against an abutment surface 35 of first annular interaction ridge 30 and a contact surface 36 (being transversally oriented with respect to engagement surface 34) designed to interact and/or interacting with a guiding surface 43 of second annular interaction ridge 31 so as to direct engagement surface 34 against abutment surface 35.

In particular, the interaction between flap 33 and first annular interaction ridge 30 is such that coupling ring 6 remains (at least during a normal use of lid-spout assembly 3) coupled to (arranged around) collar 5. It should be noted that during a normal use the user cannot detach coupling ring 6 from collar 5 guaranteeing thereby that lid 7 and coupling ring 6 remain coupled to collar 5. Furthermore, flap 33 and guiding surface 43 of second annular interaction ridge 31 are configured to interact such that engagement surface 34 abuts against abutment surface 35, i.e. they act as a guide system of the retaining group.

In more detail, flap 33 comprises a fixed terminal portion 37 being fixed to inner surface 24 and a free terminal portion 38 opposed to fixed terminal portion 37 and carrying and/or having engagement surface 34.

In particular, flap 33 is elastically moveable and/or deflectable and configured to allow for free terminal portion 38 approaching and withdrawing towards and away from inner surface 24. In other words, flap 33 is elastically moveable and configured to allow for free terminal portion 38 withdrawing and approaching from and towards outer surface 16.

Moreover, fixed terminal portion 37 defines a pivot around which flap 33 is angularly moveable. In particular, free terminal portion 38 is angularly moveable with respect to fixed terminal portion 37.

Advantageously, flap 33 is configured such to bias free terminal portion 38 away from inner surface 24 and the interaction between flap 33, in particular contact surface 36, and second annular interaction ridge 31, in particular guiding surface 43, is such to orient flap 33, in particular free terminal portion 38, towards inner surface 24. In other words, flap 33 is designed to act like a spring.

In particular, fixed terminal portion 37 acts as a hinge.

Moreover, flap 33 has an annular shape.

Preferentially, flap 33 comprises:

- a plurality of flap elements 39 angularly displaced from one another about central axis C and each one being connected to inner surface 24; and
- in particular, a plurality of connecting elements 45, each one connecting two neighboring flap elements 39 with one another.

According to some preferred non-limiting embodiments and with particular reference to FIG. 4, engagement surface 34 and/or free terminal portion 38 has a continuous shape and/or configuration and in particular presents an annular shape.

In particular, each flap element 39 and each connecting element 45 comprises and/or defines a portion of engagement surface 34 and/or free terminal portion 38.

Furthermore, fixed terminal portion 37 presents a discontinuous configuration and/or shape. In particular, each flap element 39 comprises and/or defines a portion of fixed terminal portion 37.

In particular, each flap element 39 comprises one respective flap element 39.

With particular reference to FIGS. 3 and 4, a cross-section of coupling ring 6 and flap 33, in particular with respect to a cross-sectional plane containing central axis C, is V-shaped or U-shaped.

Preferentially, flap 33 extends from inner surface 24 towards top wall 20, in particular with lid 7 being in the closed configuration. In particular, free terminal portion 38 is (axially) closer to top wall 20 than fixed terminal portion 37.

In further detail, coupling ring 6 comprises a first rim 40 and a second rim 41 opposed to first rim 40 and inner surface 24 being interposed between first rim 40 and second rim 41. In particular, connecting element 8 is connected to first rim 40.

Preferentially, fixed terminal portion 37 is connected to inner surface 24 at and/or adjacent to second rim 41.

With particular reference to FIG. 3, abutment surface 35 faces second annular interaction ridge 31.

Preferentially, each one of first annular interaction ridge 30 and second annular interaction ridge 31 comprises a respective fixed end connected to outer surface 16 and a respective free end opposed to the respective fixed end.

In particular, contact surface 36 is configured to contact and/or contacts the respective free end of second annular interaction ridge 31.

Preferentially, the respective free end of second annular interaction ridge 31 is rounded and/or presents a rounded shape.

Moreover, the respective free end of second annular interaction ridge 31 comprises guiding surface 43, in particular guiding surface 43 having a rounded shape.

With particular reference to FIG. 3, a first radial extension of first annular interaction ridge 30 is larger than a second radial extension of second annular interaction ridge 31. In particular, the first radial extension and the second radial extension are measured from central axis A to the respective free end and considering a radial axis being perpendicular to central axis A.

In other words, the respective maximum radius of first annular interaction ridge 30 is larger than the respective maximum radius of second annular interaction ridge 31.

In even other words, the respective free end of first annular interaction ridge 30 is closer to inner surface 24 than the respective free end of second annular interaction ridge 31.

Preferentially, first annular interaction ridge 30 comprises a sliding surface 42 transversal to abutment surface 35 and configured to interact with flap 33 during coupling of coupling ring 6 around collar 5. In particular, sliding surface 42 is inclined with respect to a plane being perpendicular to central axis A so as to facilitate coupling of coupling ring 6 around collar 5.

In particular, the portion of sliding surface 42 being at the respective fixed end of first annular interaction ring 30 is closer to pouring outlet 15 and/or top wall 20 (with lid 7 being in the closing configuration) than the portion of sliding surface 42 being at the respective free end of first annular interaction ring 30. In use, during coupling of coupling ring 6 onto collar 5, flap 33 is deflected by means of the interaction with sliding surface 42 so that free terminal portion 38 approaches inner surface 24.

In use, the outpouring of the pourable product from package 1 requires controlling lid 7 from the closed configuration to the open configuration. This means that the consumer needs to exert an opening force onto lid 7.

The interaction between flap 33 and first annular interaction ridge 30 and second annular interaction ridge 31 guarantees that coupling ring 6 remains coupled around collar 5.

During mounting of coupling ring 6 around collar 5, the interaction between flap 33 and sliding surface 42 facilitates the mounting of collar 5.

The advantages of lid-spout assembly 3 and/or of package 1 according to the present invention will be clear from the foregoing description.

In particular, by providing for flap 33 interacting with both first annular interaction ridge 30 and second annular interaction ridge 31 one obtains a high retaining force guaranteeing coupling of coupling ring 6 around collar 5. The interaction between flap 33 and second annular interaction ridge 31 directs free terminal portion 38 towards inner surface 24 reducing the play between flap 33 and first annular interaction ridge 30.

Furthermore, by providing for second annular interaction ridge 31 it is ensured that engagement surface 34 is always directed onto abutment surface 35 also during movement of lid 7 from the closed configuration to the open configuration. In particular, in this case, lid 7 rotates around hinge axis B and the interaction of flap 33 and/or flap element(s) 39 with second annular interaction ridge 31 guarantees that flap 33 and/or flap element(s) 39 arranged in the proximity of (at) connecting element 8 is (are) in contact with first annular interaction ridge 30 and on the other hand also guarantees that flap 33 and/or flap element(s) 39 arranged opposite to connecting element 8 does (do) not rotate around an axis defined by a respective section of fixed terminal portion 37. Such behavior is also ensured if the user exerts a force on lid 7 when having reached the open configuration.

Furthermore, the present invention also works in these cases when collar 5 is obtained from a soft material such as LDPE.

A further advantage resides in allowing for reduced insertion forces when mounting coupling ring 6 around collar 5. Such behavior is in particular due to the elastic behavior of flap 33 and its interaction with sliding surface 42. This also allows avoiding the use of slip agents during the mounting of coupling ring 6 onto collar 5.

Another advantage is seen in that the presence of flap 33, first annular interaction ridge 30 and second annular interaction ridge 31 still allows for a free rotation of coupling ring 6 and lid 7 around central axis C.

Furthermore, a gap between top wall 20 and/or side wall 21 and collar 5 is minimal.

Clearly, changes may be made to lid-spout assembly 3 and/or package 1 as described herein without, however, departing from the scope of protection as defined in the accompanying claims.

The invention claimed is:

1. A lid-spout assembly for a package having a designated pour opening and being filled with a pourable product;

the lid-spout assembly comprises at least:

a collar carrying a pouring outlet and having an outer surface;

a coupling ring arranged around a portion of the collar;

a lid configured to selectively close and open the pouring outlet; and a connecting element connecting the lid and the coupling ring with one another;

wherein the collar comprises a first annular interaction ridge protruding from the outer surface of the collar;

wherein the coupling ring comprises an inner surface facing the outer surface and having at least one flap connected to and protruding away from the inner surface;

wherein the at least one flap comprises at least one engagement surface abutting and/or designed to abut against an abutment surface of the first annular interaction ridge;

wherein the collar also comprises a second annular interaction ridge protruding from the outer surface of the collar and being axially displaced from the first annular interaction ridge;

wherein the flap further comprises at least one contact surface designed to interact and/or interacting with a guiding surface of the second annular interaction ridge so as to direct the engagement surface towards and/or against the abutment surface.

2. The lid-spout assembly according to claim 1, wherein the at least one flap comprises a free terminal portion and the at least one flap is elastically moveable so as to allow to approach and withdraw the free terminal portion to and away from the inner surface.

3. The lid-spout assembly according to claim 1, wherein the abutment surface faces the second annular interaction ridge.

4. The lid-spout assembly according to claim 1, wherein the at least one flap comprises a fixed terminal portion being fixed to the inner surface and a free terminal portion opposed to the fixed terminal portion and carrying and/or having the engagement surface.

5. The lid-spout assembly according to claim 1, wherein the second annular interaction ridge comprises a fixed end connected to the outer surface and a free end opposed to the fixed end;

wherein the contact surface is in contact with and/or is designed to contact the free end.

6. The lid-spout assembly according to claim 5, wherein the free end is rounded.

7. The lid-spout assembly according to claim 1, wherein the first annular interaction ridge and the second annular interaction ridge delimit and/or define a groove.

8. The lid-spout assembly according to claim 1, wherein a first radial extension of the first annular interaction ridge is larger than a second radial extension of the second annular interaction ridge.

9. The lid-spout assembly according to claim 1, wherein a cross-section of the coupling ring and the at least one flap is V-shaped or U-shaped.

10. The lid-spout assembly according to claim 9, wherein the first annular interaction ridge comprises a sliding surface transversal to the abutment surface, the sliding surface being configured to interact with the at least one flap during coupling of the coupling ring around the collar.

11. The lid-spout assembly according to claim 1, wherein the engagement surface is continuous.

12. The lid-spout assembly according to claim 1, wherein the lid comprises a top wall and a side wall protruding from the top wall;

wherein the at least one flap extends from the inner surface-towards the top wall.

13. A package filled with the pourable product comprising the lid-spout assembly according to claim 1.

14. The package according to claim 13, and further comprising a separation membrane covering the designated pour opening;

wherein the lid-spout assembly is fused or bonded or molded to the package and around the designated pour opening.

15. The package according to claim 13, wherein the package further comprises a main body having the designated pour opening and being formed from a multilayer composite packaging material.

* * * * *